United States Patent [19]

Zumchak

[11] 3,998,463

[45] Dec. 21, 1976

[54] NAVAL COMBAT GAME

[76] Inventor: Joseph Zumchak, 703 Ackerman Ave., Glen Rock, N.J. 07452

[22] Filed: May 15, 1975

[21] Appl. No.: 577,944

Related U.S. Application Data

[63] Continuation-in-part of Ser. No. 450,608, March 13, 1974, abandoned.

[52] U.S. Cl. ..... 273/131 BB; 273/130 G; 273/130 D

[51] Int. Cl.[2] ..... A63F 3/02

[58] Field of Search ..... 273/130 R, 130 D, 130 G, 273/131 R, 131 AB, 131 BB, 131 K, 137 R

[56] References Cited

UNITED STATES PATENTS

| | | | |
|---|---|---|---|
| 972,382 | 10/1910 | Johnson-Jervis | 273/131 BB |
| 1,023,375 | 4/1912 | Hammond, Jr. | 273/131 BB |
| 1,254,380 | 1/1918 | Whitmore | 273/137 R |
| 1,279,691 | 9/1918 | Hayes | 273/131 AB |
| 1,289,471 | 12/1918 | Jones | 273/131 R |
| 1,299,731 | 4/1919 | Ireland | 273/131 BB |
| 1,579,327 | 4/1926 | Knowles | 273/131 BB |
| 1,613,974 | 1/1927 | Yejoff | 273/131 BB |
| 1,666,953 | 4/1928 | Tuttle et al. | 273/131 BB |
| 2,313,303 | 4/1943 | Szatrow | 273/131 BB |
| 2,414,165 | 1/1947 | Paschal | 273/131 K |

FOREIGN PATENTS OR APPLICATIONS

| | | | |
|---|---|---|---|
| 325,604 | 2/1930 | United Kingdom | 273/137 R |

*Primary Examiner*—Richard J. Apley
*Assistant Examiner*—Harry G. Strappelo
*Attorney, Agent, or Firm*—Richard L. Miller

[57] ABSTRACT

A naval war game utilizing the skill of two or more contestants in simulating naval warfare. The game includes a game board having a playing field thereon and including a checkerboard section forming the open sea and a perimeter section of additional squares forming coastal waters. Tabular blocks adjacent the coastal waters form seaports. The squares and blocks on the checkerboard define the game piece positions. Two sets of distinguishingly identifiable sets of game pieces are included. Each of the game pieces is of a size capable of occupying and fitting within a single square. Each of the game pieces represents a naval vessel and includes a particular naval characteristic in a specified quantity, wherein such quantity represents a particular capability of the respective game piece with relationship to the game.

9 Claims, 17 Drawing Figures

NAVAL COMBAT GAME

This application is a continuation-in-part of copending application Ser. No. 450,608 filed on Mar. 13, 1974, now abandoned by the inventor of the present application.

BACKGROUND OF THE INVENTION

1. Field of the Invention

This invention relates to a game of skill, and more particularly to a board game simulating naval warfare to be played by at least two players each of whom represents a fleet of warships and by means of strategy the ships are moved and maneuvered to sink the opponent's fleet of ships. The game is referred to by the name "SALVO".

2. Description of the Prior Art

Numerous game apparatus are presently available, many of which require the use of game pieces to simulate a naval warfare battle or conquest. In many of the games there are utilized a gameboard with a particular map of various locations and wherein the game pieces represent various naval vessels. However, the general purpose of such games is to require the use of strategy and mental capacity of the players rather than the use of any chance. Accordingly, it is necessary to have a plurality of ships wherein each of the ships has various capabilities and movements with relationship to the game. Generally, with most prior art games the game board has a single pattern of lines or squares, each of which represents a position for the game pieces. The gameboard is generally of uniform lines or spaces throughout the board and the capabilities of each of the ships determine the movement on the various positions.

Since the game is based upon the skill of the players, it must be so arranged to provide adequate challenge to the players. With most prior art games of this type, because the gameboard is uniform throughout, the game becomes quite simplified since the rules governing the capabilities of each of the ships apply uniformly throughout the gameboard playing field. In order to add complexity to the game and additional challenge to the players, it is usually necessary to provide numerous complex rules limiting the capabilities of the various game pieces under particular circumstances during the game process. Such rules frequently become complicated to the extent that the players become frustrated with the numerous variations. On the other hand, should the number of capabilities be limited, the game becomes too easy and does not provide sufficient challenge for the skill and acumen of the players.

It is therefore necessary to strike a balance in the complexity of the game including the various movements of the playing pieces and the playing board so as to provide on the one hand sufficient ease for understanding the game, and on the other hand sufficient complexity of providing a challenge to the skill of the players.

Furthermore, with most prior art games there is only a single set of rules which are capable of being utilized for the game. Since the rules are generally quite complex, the player must be thoroughly familiar with the rules before utilizing the game. There is no way for him to simplify the game either to provide a shorter game time or for use of players of younger ages.

SUMMARY OF THE INVENTION

It is accordingly an object of the present invention to provide a game of skill which avoids the aforementioned problems of prior art games.

A further object of the present invention is to provide a game of skill simulating naval warfare which provides a balance in the complexity of movement of the game pieces and the gameboard, so that sufficient challenge is provided to the players to make the game interesting without making it too complex to be understood.

A further object of the present invention is to provide a game of skill utilizing a unigue game board having a plurality of different sections of a playing field wherein different capabilities of movement of the game pieces are provided for each section of the playing field.

Still a further object of the present invention is to provide a game of skill utilizing a unique gameboard and game pieces which permit the playing of both a simplified version and a complex version of the game.

Yet another object of the present invention is to provide a game of skill utilizing game pieces representing naval vessels and each having naval characteristics thereon in a particular numeric quantity is representative of the capability of the game piece with relationship to the game.

Still a further object of the present invention is to provide a game of skill utilizing only the strategy of the players, devoid of any element of chance.

A further object of the present invention is to provide a game of skill utilizing game pieces representative of naval vessels, wherein at least some of the vessels have two positions of use each representative of different capabilities of the game piece with relationship to the game.

These and other objects, features and advantages of the invention will, in part, be pointed out with particularity, and will, in part, become obvious from the following more detailed description of the invention taken in conjunction with the accompanying drawing, which forms an integral part thereof.

Briefly, the invention describes a naval warfare game, including a game board having thereon a playing field including a checker squared area which forms the open sea. A perimeter of one row of squares of the same size as the checker squares, extending from the checker squares and surrounding them, forms an area of coastal waters. Tabular blocks extend from each of the coastal water squares and form seaports. The squares representing the open sea, as well as the squares representing the coastal waters and the blocks defining the seaports, each define a game piece position. The game further includes two distinguishingly identifiable sets of game pieces, each game piece being of a size capable of occupying and fitting within a single square. Each of the game pieces represents a naval vessel, and each game piece includes a numerical quantity of a particular naval characteristic wherein the number represents a speicified capability of the respective game piece with relationship to the game.

BRIEF DESCRIPTION OF THE DRAWING

In the drawing:

FIGS. 2*a*–9*a* represent the figures of one set of game pieces, and

FIGS. 2*b*–9*b* represent another set of game pieces, wherein FIGS. 2*a* and *b* represent an aircraft carrier;

FIGS. 3*a* and *b* represent a battleship; FIGS. 4*a* and *b* represent a cruiser; FIGS. 5*a* and *b* represent a destroyer; FIGS. 6*a* and *b* represent an emerged submarine; FIGS. 7*a* and *b* represent a submerged submarine; FIGS. 8*a* and *b*, represent a flagship, and FIGS. 9*a* and *b* represent a naval airbase aircraft.

DESCRIPTION OF THE PREFERRED EMBODIMENT

Figure 1:
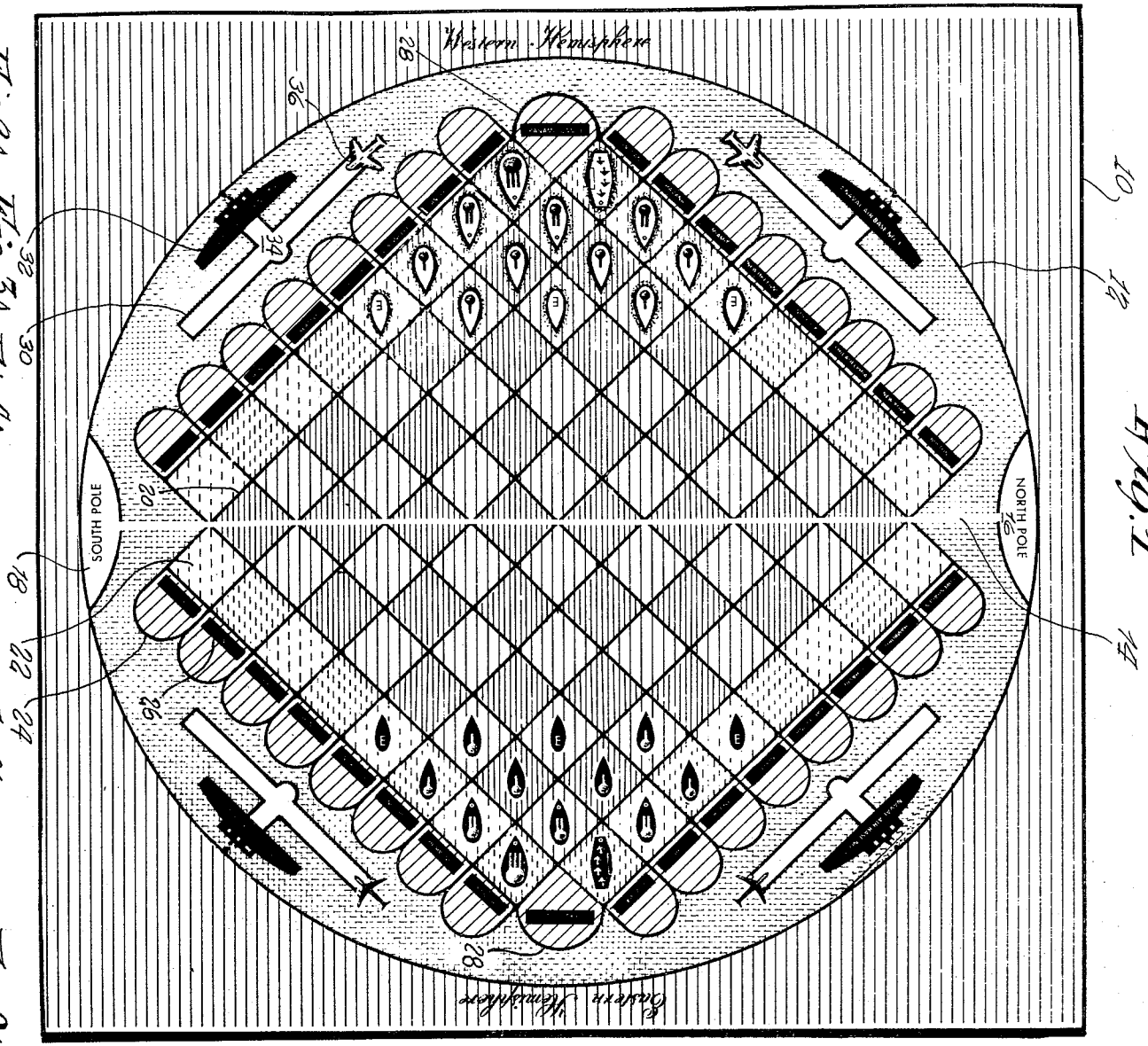
FIG. 1 is a plan view of the gameboard.

Referring now to FIG. 1 there is shown the gameboard 10 including a playing field contained within a circle 12 that extends nearly to the outer edges of the board and presents a sphere. The sphere is divided in half by a vertical line 14 which forms the prime meridian and divides the sphere into an Eastern hemisphere on the right and a Western hemisphere on the left. At each extreme end of the prime meridian 14 is an arc. The arc 16 at the top denotes a North Pole and the arc 18 at the bottom denotes a South Pole.

A checker squared area is formed within the sphere having the line 20 as its outer perimeter. The square includes 8 by 8 individual blocks forming a total of 64 blocks. The blocks can be formed in alternatingly different colors or shades, such as light blue and medium blue. This area forms the open sea. The checker squared pattern is so positioned so as to have the prime meridian 14 diagonally bisecting the checker squared area. In this manner the checker squared area is divided into two triangles. For each hemisphere, each triangle contains 28 full blocks and 8 half blocks.

Extending from and adjacent to each of the outer squares of the checker squared area is an additional single row of squares 22 each square of which is the same size as the blocks contained in the checkered square area. The outer perimeter row forms the coastal waters. In each hemisphere there are 16 squares of such coastal waters thereby making a total of 96 squares for the total sea area including the open sea and the coastal waters. The squares in the coastal waters are made to appear of a different color, shade, or design to distinguish them from the open sea.

Adjacent to and extending from each of the coastal water squares is a tabular block 24, each of which represents a seaport. Each of the seaports 24 can be made of a different color, shade or design to distinguish it from that of the total sea. Each of the seaports includes a name on a tag 26 to identify the seaports. A total of 16 such seaports are present in each of the hemispheres.

In the two opposing diagonal corners of the checker squared area are placed dome shaped blocks 28. These corner blocks represent canal seaports and can be designated by the same color shade, or design as the other seaports 24. This makes a total number of 17 seaports for each hemisphere.

Directly behind each line of seaports on each side of the hemisphere is a designated area 30 representing an airport and including a station 32 and a runway 34. A figure of an airplane 36 can be positioned on the airbase. These areas represent naval air bases and a total of two are available for each hemisphere.

Each of the naval air bases can be made of a different color, shade or design to distinguish it from the remaining game board and make it clearly identifiable.

Referring now to FIGS. 2–9 there are shown the game pieces of the present invention. Two distinguishingly identifiable sets of game peices are utilized. One set can be distinguished from the other by means of different colors, shades, or designs. As shown in the drawing one set, FIGS. 2*a*–9*a*, are shown in white while the second set, FIGS. 2*b*–9*b*, are shown in black.

Figures 2A, 3A, 4A, 5A, 6A, 7A, 8A, 9A:
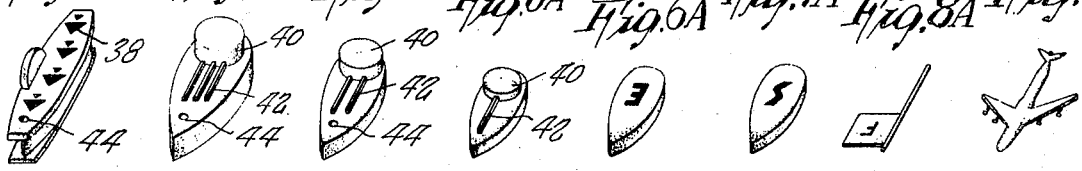
Figures 2B, 3B, 4B, 5B, 6B, 7B, 8B, 9B:
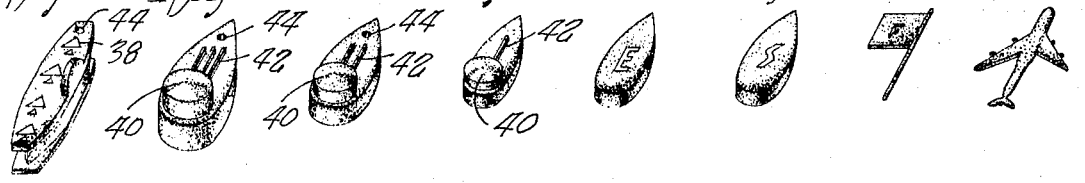

FIGS. 2*a* and *b* represent symbolically an aircraft carrier which bears four figures of simulated aircraft on its flight deck. FIGS. 3*a* and *b* show a perspective view of a game piece which symbolically represents a battle ship. Each ship bears a single turrent 40 with three guns 42 on its deck. FIGS. 4*a* and *b* show a perspective view of a game piece which symbolically represents a cruiser. Each cruiser bears a single turret 40 with two guns 42 on deck. FIGS. 5*a* and *b* show a perspective view of a game piece which symbolically represents a destroyer. Each destroyer bears a single turret 40 and a single gun 42 on deck. Each of the ships shown in FIGS. 2–4, that is the aircraft carrier, the battleship and the cruiser, contain a hole therein 44 for use in conjunction with the flag shown in FIGS. 8*a* and *b*, as will hereinafter be described.

FIGS. 6*a* and *b* show a perspective view of a game piece symbolically representing an emerged submarine. The letter E thereon designating the word "emerged". FIGS. 7*a* and *b* show a perspective view of a game piece symbolically representing a submerged and bearing the letter S engraved thereon to identify it as a "submerged" submarine. The game pieces in FIGS. 6*a* and *b* and 7*a* and *b* can be the same piece on one side of which is engraved the letter E on the other side of which is engraved the letter S, such that the game piece can be turned in either of its two positions to respectively represent the two playing pieces.

FIGS. 8*a* and *b* show a perspective view of a game piece representing a flag which bears the letter F contained thereon. The flag shown in FIGS. 8*a* and *b* can be inserted into the holes 44 of either the aircraft carrier, the battleship, or the cruiser to identify that particular ship as the flagship of the entire fleet.

FIGS. 9*a* and *b* show a perspective view of game pieces symbolically representing an aircraft for use with the naval air base shown in FIG. 1.

In one embodiment of the invention the gameboard is approximately 12 inches by 12 inches and the square forming the open sea is 6 inches by 6 inches with each square being of approximately 0.75 of an inch on a side. In the embodiment, the size of the game pieces are up to about 0.75 inches long and up to about 0.40 inches across the largest point of their middle. In this manner, the game pieces can fit within and occupy a single square of the playing field. It is understood, that the gameboard can be of different sizes and of different colors. Similarly, the game pieces can also be made of a three dimensional structure or alternately be made on a flat paper or cardboard or other means which can facilitate their use as game pieces. In the embodiment, the open sea has blocks of alternatingly colored light blue and dark blue, the coastal waters additionally included lines thereacross, the seaports are green and the background sphere is yellow.

It is noted that in FIGS. 2–5 the various structures representing naval vessels contain a particular naval characteristic thereon such as a deck gun or aircraft. This, in FIGS. 2*a* and *b* each aircraft carrier bears 4 aircraft, in FIGS. 3*a* and *b* each battleship bears 3 guns from a single turret; in FIGS. 4*a* and *b* each cruiser bears 2 guns from a single turret, and in FIGS. 5*a* and *b* each destroyer bears a single gun from a single turret. The quantity of the particular naval characteristic appearing on the naval vessel represents a specific capability of that respective game piece with relationship to the game. Thus, the aircraft carrier has a capability of firing a distance of four spaces utilizing its first salvo; the battleship has a capability of firing a distance of three spaces on its first salvo, etc.

In the particular description as shown the seaports are named in a particular order as follows:

| WESTERN HEMISPHERE | EASTERN HEMISPHERE |
|---|---|
| | (North Pole) |
| Boston | Copenhagen |
| New York | Hamburg |
| Philadelphia | LeHavre |
| Norfolk | Barcelona |
| New Orleans | Naples |
| Miami | Malta |
| Havana | Athens |
| San Juan | Istanbul |
| PANAMA CANAL | SUEZ CANAL |
| Acapulco | Bombay |
| San Diego | Singapore |
| Los Angeles | Saigon |
| San Francisco | Hong Kong |
| Seattle | Shanghai |
| Honolulu | Tokyo |
| Lima | Manila |
| Santiago | Sydney |
| | (South Pole) |

Rules of the Game

In order to understand the rules of the game, the following is a list of terminology utilized in the rules, together with the meaning of such terminology.

| TERMS | MEANING |
|---|---|
| salvo | a move destined to sink (remove) an enemy ship |
| warship (ship) | a gameboard piece |
| leg | a block on the gameboard |
| sea | the area on the board where warships travel |
| sea battle | the game |
| open sea | the legs other than those in coastal waters |
| total sea | the open sea and coastal waters combined |
| coastal waters | the legs adjacent to seaports |
| operation | a single opportunity (move) |
| range | the distance |
| starboard | the direction right |
| port | the direction left |
| seaport | the space on the shore side of coastal waters |
| to sail | to move |
| to cruise | to move in the process of changing location |
| to fire | to move in the process of sinking a ship |
| to sink | to remove |
| to repulse | to block |

In the following explanation of the rules, the various game pieces are abbreviated and various other abbreviations are utilized.

The following is a list indicating the abbreviations and their meaning as well as an indication of the number of game pieces typically provided in order to play the game.

| Classification | Abbreviation | Amount per Fleet |
|---|---|---|
| Aircraft carrier | AA | 1 |
| Battleship | BB | 1 |
| Cruiser | CC | 3 |
| (Flagship) | FF | 1(*) |
| Destroyer | DD | 6 |
| Submarine | SS | |
| Emerged submarine | ESS | 3 |
| Submerged submarine | SSS | |
| Naval Air Base aircraft | NAB | |
| Eastern Hemisphere NAB No. 1 | EHNAB No. 1 | 1 |
| Eastern Hemisphere NAB No. 2 | EHNAB No. 2 | 1 |

-continued

| Classification | Abbreviation | Amount per Fleet |
|---|---|---|
| Western Hemisphere NAB No. 1 | WEHNAB No. 1 | 1 |
| Western Hemisphere NAB No. 2 | WEHNAB No. 2 | 1 |

(*)One of the above capital ships

The general rules are as follows:

Each ship classification has a prescribed "cruising" and "firing" capability, and these cannot be altered, except as may be provided for within the rules set forth herein. For quick reference, see SALVO Chart. For detailed instructions, see rules under pertinent ship designation.

A ship cannot cruise and fire in the same operation. The player may cruise a single ship or a combination of certain ships in a single operation (see rules), but he may fire only a single ship in a single operation. Or he may choose to pass. It is not compulsory either to fire and sink an enemy ship or to cruise, but if one of the players chooses to pass up his turn to cruise or sink his opponent's ship, and his opponent also decides to do so, then it is incumbent upon the first that passed, to make the next move.

Each square block (colored blue) constitutes a "leg". Distances are measured in legs. When cruising or firing, a ship may be moved in any direction — forward, backward, diagonally, or any combination thereof — consistent with the rules prescribed herein. If a ship is entitled to cruise or fire in more than 1 leg, it may do so with any combination of directions. For example: An AA, which could fire a distance of 4 legs on its first salvo may, if desired, fire in a manner as to reach its target by circumventing another ship provided, of course, it does not exceed the number of legs in which it is entitled to move. A ship may also cruise in any combination of directions, within its capability, but may not return to its original position in the same operation.

A ship cannot enter a leg in which an enemy ship rests without sinking the ship. To sink an enemy ship, the ship that fires must move (the number of legs prescribed in the rules under pertinent ship classification) to the location of the target ship, remove that enemy ship, and remain in the location. A subsequent "cruising" move is not permitted within that operation, but if entitled to sink other ships within that operation, and he is in a position to do so, the player may fire the remaining salvos to which he is entitled, remove the ships that were sunk, and rest his ship in the leg which harbored the final victim of that operation.

Two ships cannot occupy the same leg together, except that a submerged (SSS) and any other friendly ship (but not another SSS) may rest together within the same leg. Any ship (except a SSS) may cruise over a friendly SSS just as though that leg were not occupied.

Moving Warships at Sea

The following rules for all classifications of warships are applicable in all instances except for operations involving ships entering and departing seaports and the sinking of:

1. submerged submarines;
2. flagships, and
3. ships while in seaports.

The AIRCRAFT CARRIER — AA

The AA has a cruising range of two legs in each operation, or the AA may choose to sail one leg and permit a DD or an ESS to sail one leg in the same single operation.

The AA has a firing range of one, two, three or four legs on the first salvo and only one leg on the second (final) salvo. When firing, the AA can sink a maximum of two ships in one operation. The first ship to be sunk must be not more than four legs distant, but could be less distant; the second ship to be sunk must be not more than 1 leg distant from the location of the AA after sinking the first ship.

The BATTLESHIP — BB

The BB has a cruising range of one leg in each operation.

The BB has a firing range of one, two, or three legs on the first salvo; one or two legs on the second salvo and only one leg on the third (final) salvo, all in a single operation. The first ship to be sunk must be not more than 3 legs distant from the location of the BB, but could be less distant; the second ship to be sunk must be not more than two legs distant from the location of the BB after sinking the first ship, but could be one leg distant; and the third ship to be sunk must be not more than one leg distant from the location of the BB after sinking the second ship.

The CRUISER — CC

The CC has a cruising range of two legs in each operation, or a CC may choose to sail one leg and permit a DD or an ESS to sail one leg in the same single operation. Two CCs cannot cruise one leg apiece in the same operation.

The CC has a firing range of one or two legs on the first salvo and only one leg on the second salvo. When firing, the CC can sink a maximum of two ships in one operation. The first ship to be sunk must be not more than two legs distant, but could be one leg distant; the second ship to be sunk must be not more than one leg distant from the location of the CC after sinking the first ship.

The DESTROYER — DD

The DD has a cruising range of one, two or three legs in each operation, or the DD may move one leg and permit an AA or a CC or an ESS (not a SSS), to move one leg in the same single operation; or, one DD may move two legs and another DD or an ESS one leg; or, three DDs may move one leg each, all in the same single operation.

The DD has a firing range of only one leg on a single salvo. When firing, the DD can sink a maximum of one ship in a single operation, and the ship to be sunk must be not more than one leg distant.

The SUBMARINE — SS

The SS can operate under two conditions: Emerged or submerged. To change from one condition to the other (emerged to submerged, or submerged to emerged), the SS is required to consume an entire operation without changing location, and the posture of the ship is inverted (capsized). Normally, the SS assumes an emerged position at the beginning of the battle. The ship is placed with the "E" shown on topside to denote that the ship is emerged. To denote that the ship is submerged, the ship must be turned over and the "S" is shown on topside. The SS must continue to operate in its contemporary condition until it is sunk or its condition is reversed by employing the rules set forth in this chapter. Its condition may be altered as often as may be desired, but each change shall consume an entire operation, without changing the ships location.

The EMERGED SUBMARINE — ESS

The ESS has a cruising range of two legs in each operation, or an ESS may cruise one leg and permit one DD to cruise one or two legs or two DDs to cruise one leg apiece in the same operation. Two ESSs may not cruise one leg apiece in the same operation.

The ESS has a firing range of only one leg on a single salvo. When firing, the ESS can sink a maximum of one ship in a single operation and the ship to be sunk must be not more than one leg distant, but if a SSS occupies that leg together with another ship, then both ships shall be considered sunk within that single operation.

The SUBMERGED SUBMARINE — SSS

The SSS has a cruising range of one leg in each operation.

The SSS has a firing range of one leg on the first salvo and one leg on the second (final) salvo. When firing, the SSS can sink a maximum of two ships in one operation. The first ship to be sunk must be not more than one leg distant, and the second ship to be sunk must be not more than one leg distant from the location of the SSS after sinking the first ship, but if a SSS occupies the leg together with another ship, then both ships shall be considered sunk within that single operation.

A SSS must be considered sunk when an enemy ship enters the leg in which it is resting, but any friendly ship, except another SSS, may sail over or occupy the same leg simultaneously, but two SSSs cannot occupy the same leg.

Any ship that chooses to sink a SSS can do so only on the first salvo and forfeits any remaining salvos to which it might otherwise be entitled in that operation. If at that time the SSS occupies a leg together with another ship, both ships must be considered sunk.

The FLAGSHIP — FF

The flagship can be any single capital ship (AA, BB or CC) selected by the player to be the principal ship of his fleet, the ship on which the fleet commander (admiral) is present and from which he commands the fleet. To indicate which of his ships is the flagship, the player shall place upon the forecastle (the bow) of that ship a symbolic flag bearing the letter "F" upon it, conforming in shade to that of the ships of that fleet.

A player may change his FF as often as he wishes, provided each ship designated as FF is in command for no less than 3 operations. The transfer of flagships can be accomplished only by expending an entire operation without changing the location of any ships, and by transferring the flag from the old to the new FF.

The FF shall maintain all the capabilities that it normally possesses according to the classification of the particular ship bearing the flag, but is shall enjoy the following added advantage: Any ship that chooses to fire at a FF can do so only on the first salvo and forfeits any remaining salvos to which it might otherwise be entitled in that operation. Once a FF is sunk, that fleet is no longer entitled to have another flagship.

Moving Warships In and Out of Seaports

Friendly ships may visit or seek refuge in home seaports, but while in port they cannot fire and sink any ships. In order for any ship to visit or take refuge in a home seaport it must first be located in one of the legs that comprises the coastal waters of its own hemisphere and enter port in a single operation from that location. All ships that enter seaports from coastal waters or enter coastal waters from seaports, regardless of their cruising or firing capabilities on the open sea, can do so only be moving one leg.

Upon entering port, a ship can, by virtue of that single operation, enter any one of the ports that is located on that side of the hemisphere from any leg in those coastal waters and may rest that ship in that port indefinitely. Subsequently, in a new operation, that ship may:

1. venture out to sea again by first returning in a single operation to any one of the legs in its coastal waters on its side of the hemisphere, provided there is no ship (friendly or enemy) resting in that leg; or
2. it may move to any other port on its side of the hemisphere in a single operation; or
3. it may move to its canal seaport in a single operation and on a subsequent operation it may move from that canal seaport to any other home seaport (on either side) or to any leg in its own coastal waters (on either side) provided there is no ship (friendly or enemy) resting in that leg. Or it may choose to remain in its original port indefinitely, subject to a mandatory move only when that fleet has no other ships capable of being moved.

It cannot be moved from a seaport on one side of the hemisphere to a seaport on the other side of the hemisphere without first stopping at its canal seaport.

After having visited three seaports consecutively (the canal seaport included), a ship may not visit another seaport without first re-entering its coastal waters.

A ship that has returned to sea from port may return to a seaport only once again, under identical rules as pertain for the first visit to a seaport, and is entitled to visit not more than three seaports on its second venture from sea to port. After that ship returns to sea from a port for a second time, there shall be no additional opportunity for that ship to visit any seaport again.

Ships in home ports are protected in that they cannot be fired upon by any ship, regardless of classification, except under the following condition: The firing ship must initiate its operation while in coastal waters from one of the three legs directly or diagonally adjacent to the seaport in which the target ship is located. This is to say that it must be not more than one leg distant. The firing ship must, after sinking its victim, return to the same leg from which it began that operation, inasmuch as an enemy ship cannot "occupy" an opponent's seaport.

Ships in home seaports are also protected by the fact that each fleet has a naval air base on each side of its hemisphere, and each NAB is capable of sinking one (only one) enemy ship of any classification that may be found in its coastal waters. Whether the enemy ship reaches the coastal waters as a result of cruising or firing, it may be vulnerable to attack from that NAB. If a ship reaches its opponent's coastal waters in the process of sinking a ship and departs those coastal waters in the same operation by means of sinking another ship, it may still be in jeopardy. Note the following:

Example: If an enemy battleship, which has the capability of firing three salvos in a single operation is discovered to have sunk a ship in coastal waters on its first or second salvo and proceeds to sink another ship away from coastal waters, the player whose ships were in the process of being sunk may select to nullify those salvos that were effected after the battleship sank the ship located in coastal waters, and he may, in turn, sink that BB with the air power from the NAB on that side of the hemisphere, if that NAB still has that capability. If the NAB's power has already been expended, then he cannot nullify any of the BB's salvos, or if "its NAB" fails to detect the transit of the BB in its coastal waters, then the BB would be entitled to consummate its actions with impunity.

In addition to providing refuge, the seaports may be utilized for the purpose of transporting a ship more rapidly from one side of the sea to the other. For example: A BB, which can cruise only in one leg per operation, and which may be located in coastal waters at one end of the sea, can, in a matter of three operations, trasfer itself to the opposite side of the hemisphere by undertaking the following actions. The ship enters a seaport in the first operation, transfers to the canal seaport in the second operation and transfers to a seaport on the other side of the hemisphere in the third operation, thus being transported a considerably greater distance in three operations than it can accomplish by cruising through the sea. This method could be used to transplant the location of certain ships strategically, but it must be done consistent with all the other rules that pertain.

NAVAL AIR BASES (NAB)

Each NAB is capable of providing only one successful aircraft strike, and that can be effected only on an enemy ship that may be found in the coastal waters on its side of its own canal seaport, either resting, or in the process of sinking ships.

After an aircraft sinks a ship, the NAB to which that aircraft belongs is thenceforth powerless to inflict any further casualties and, therefore, all ships subsequently shall be immune to danger from that particular NAB.

To illustrate that the NAB has the potential of sinking a ship, the symbolic airplane shall be exhibited on the runway of the airfield. After the NAB completes its action of sinking a ship, the symbolic airplane shall be removed from and remain absent from the NAB for the remainder of the game to denote that that NAB is no longer capable of sinking any other ship.

The following chart represents a summary of the various game pieces and their capabilites both for cruising and firing.

(All numbers pertain to capabilities in a single operation)

| | AA | BB | CC | DD | ESS | SSS | NAB |
|---|---|---|---|---|---|---|---|
| CRUISING RANGE | | | | | | | |
| (number of legs when at sea) | 2 | 1 | 2 | 3 | 2 | 1 | — |
| (number of legs when sailing | | | | | | | |

-continued

| | | AA | BB | CC | DD | ESS | SSS | NAB |
|---|---|---|---|---|---|---|---|---|
| in or out of seaports) | | 1 | 1 | 1 | 1 | 1 | 1 | — |
| FIRING RANGE (number of legs) | 1st salvo | 4 | 3 | 2 | 1 | 1 | 1 | 1(*) |
| | 2nd salvo | 1 | 2 | 1 | 0 | 0 | 1 | 0 |
| | 3rd salvo | 0 | 1 | 0 | 0 | 0 | 0 | 0 |
| Maximum number of ships that may be sunk when a flagship or a SSS is not a victim | | 2 | 3 | 2 | 1 | 1 | 2 | 1(*) |
| Maximum number of ships that may be sunk when a flagship or a SSS is a victim | | 1 | 1 | 1 | 1 | 1 | 1 | 1(*) |
| Maximum number of ships that may be sunk involving the sinking of a SSS that occupies the same leg wherein rests another ship | | 2 | 2 | 2 | 2 | 2 | 2 | 2(*) |
| Maximum number of ships that may be sunk involving the sinking of a ship in port | | 1 | 1 | 1 | 1 | 1 | 1 | — |

(*)Target ship must be in pertinent coastal waters only

The foregoing are the rules utilized for playing a complete game. However, since such a strategic game is very comprehensive, there is also provided a simplified version to familiarize the players with the concepts and moves of the game. Also, the simplified version can be played with younger children for whom the more strategic version may be too difficult to comprehend. In the simplified version only three types of ships are utilized: the battleship, the cruiser and the destroyer. In the simplified version each set of game pieces inludes a single battelship, two cruisers and three destroyers. The following chart summarizes the rules for using the game in its simplified version.

| CRUISING RANGE | FIRING RANGE |
|---|---|
| When cruising you can move<br>1 BB 1 leg (block), or,<br>1 CC 2 legs, or<br>1 DD 3 legs, . . . or,<br>1 CC 1 leg and 1 DD 1 leg, or<br>1 DD 2 legs and 1 DD 1 leg, or<br>3 DD 1 leg each.<br><br>NOTE: When cruising, up to 3 ships (DDs) can be moved in a single operation. You may move a lesser number, but never more than the number prescribed. | When firing you can move a<br>BB - 3 legs on the 1st salvo and<br>2 legs on the 2nd salvo and<br>1 leg on the third salvo.<br>(The BB can sink up to 3 ships in a single operation) . . . or, a<br>CC - 2 legs on the 1st salvo and<br>1 leg on the 2nd salvo.<br>(The CC can sink up to 2 ships in a single operation) . . . or, a<br>DD - 1 leg on the 1st salvo.<br>(The DD can sink only one ship in a single operation) |

NOTE: When firing, only one ship can fire (be moved) in a single operation, and it must replace the enemy ship that is being sunk. The ship firing can sink a lesser number of ships or traverse a lesser number of legs than those within its capability, but never more than the number prescribed.

When playing the simplified version, the same general rules obtain as for the comprehensive version. However, since only one battleship, two cruisers and three destroyers are employed for each fleet, rules governing the other ships, the flagship, seaports and naval air base aircraft become moot and need not be considered.

At the inception of the battle each player shall deploy his reduced fleet in a manner that places his battleship in the block which constitutes the corner leg of the open sea near his canal seaport, and his cruisers in the two blocks immediately in front of the battleship, and his distroyers in the three blocks immediately in front of the cruisers.

The invention, therefore, constitutes a means whereby the game can be played in either a complex or simplified version. The game of the present invention provides a balance for sufficient complexity to challenge the players and yet avoids excessive complexities to frustrate the players, and it affords beginners or less capable players the opportunity to participate in this game on a strategically lower plane, without altering the general concepts of the invention.

The game includes various game pieces, each game piece having two levels of movement, one for cruising and one for firing. Furthermore, the game pieces are identified by a quantity of naval characteristics wherein the quantitiy is representative of a particular capability of the game piece with relationship to the game.

There has been disclosed heretofore the best embodiment of the invention presently contemplated. However, it is to be understood that various changes and modifications can be made thereto without departing from the spirit of the invention.

What is claimed is:

1. In a naval warfare game, the combination of a gameboard having thereon a playing field including a square area of individual checker squares forming the open sea, a perimeter of one row of squares of the same size as the checker squares extending therefrom and completely surrounding all four sides of the square area and forming coastal waters, a square of the coastal waters respectively connected to a square of the open sea, and individual tabular blocks extending from each of the coastal water squares on all four sides and forming seaports, said squares of the open sea, squares of the coastal waters and seaports all defining game piece positions, ans two distinguishingly identifiable sets of game pieces, each game piece being of a size capable of occupying and fitting within a single square and representing a naval vessel, each game piece including a prescribed amount of a particular naval characteristic representative of the respective naval vessels, wherein said presribed amount represents the number of position moves which the repsective game piece has with relationship to the game, wherein said gameboard playing field further comprises a center line diagonally bisecting the square area of individual checker squares forming an Eastern and Western hemisphere on either side thereof, two corner areas respectively positioned adjacent the other diagonally opposed corners of the square area forming canal seaports, four areas respectively positioned adjacent each of the four sides of the square area on the outside of the seaports forming naval airbases, and a circumscribing circle about the entire playing field forming an entire sphere.

2. The combination of claim 1 and wherein each of said sets of game pieces are of a different color from each other.

3. The combination as in claim 1 and wherein respective ones of said game pieces are characterized by structure representing respectively an aircraft carrier, a battleship, a cruiser, a destroyer, and a sumbmarine.

4. The combination as in claim 3 and wherein said naval characteristic represents aircraft positioned on said aircraft carrier.

5. The combination as in claim 4 and wherein said naval characteristic is a gun extending from a single turret, the number of guns extending from said single turret representing said number of position moves.

6. The combination as in claim 5 and wherein said destroyer contains a single turret with a single gun on deck, said cruiser contains a single turret with two guns on deck, and said battleship contains a single turret with three guns on deck.

7. The combination as in claim 3 and wherein said structure represents a submarine and includes on one side thereof a symbolic designation representing a submerged submarine, and on the other side thereof a symbolic designation representing an emerged submarine, only one of said symbolic designations being visible at a single time.

8. The combination as in claim 3 and wherein said game pieces include a hole therein, and further comprising a pair of flags capable of being inserted in the hole of a game piece, the pair of flags being distinguishingly identifiable in a manner similar to that distinguishingly identifying the two sets of game pieces.

9. The combination as in claim 3 and further comprising at least two additional game pieces being distinguishingly identifiable from each other in a manner similar to that distinguishing the two sets of game pieces, said additional game pieces characterized by structure representing an aircraft.

* * * * *